US008142303B2

(12) United States Patent
Endres

(10) Patent No.: US 8,142,303 B2
(45) Date of Patent: Mar. 27, 2012

(54) SYSTEM AND METHOD FOR GOLF-SWING TRAINING

(76) Inventor: William Endres, Buckley, WA (US)

( * ) Notice: Subject to any disclaimer, the term of this patent is extended or adjusted under 35 U.S.C. 154(b) by 2107 days.

(21) Appl. No.: 10/857,093

(22) Filed: May 28, 2004

(65) Prior Publication Data

US 2005/0124429 A1 Jun. 9, 2005

Related U.S. Application Data

(60) Provisional application No. 60/526,200, filed on Dec. 3, 2003.

(51) Int. Cl.
*A63B 69/36* (2006.01)

(52) U.S. Cl. ..... 473/223; 473/221

(58) Field of Classification Search ..... 473/219, 473/220, 221, 222, 223, 224, 419–226
See application file for complete search history.

(56) References Cited

U.S. PATENT DOCUMENTS 3,226,704 A * 12/1965 Petrash ..... 473/224
3,730,530 A * 5/1973 Oka et al. ..... 473/234
4,094,504 A * 6/1978 Barasch ..... 473/461
4,830,377 A * 5/1989 Kobayashi ..... 473/224
5,082,283 A * 1/1992 Conley et al. ..... 473/234
5,161,802 A * 11/1992 Daechsel ..... 473/220
5,184,826 A * 2/1993 Hall, Jr. ..... 473/224
5,277,428 A * 1/1994 Goodwin et al. ..... 473/224
5,441,269 A * 8/1995 Henwood ..... 473/220
5,692,964 A * 12/1997 Smith et al. ..... 473/220
6,398,663 B1 * 6/2002 Lin ..... 473/220
6,413,167 B1 * 7/2002 Burke ..... 473/224
6,739,981 B1 * 5/2004 Lin ..... 473/219

* cited by examiner

*Primary Examiner* — Nini Legesse
(74) *Attorney, Agent, or Firm* — Frommer Lawrence & Haug LLP; Patrick R. Turner

(57) ABSTRACT

A golf-swing training device for improving ball-driving distance and accuracy. The training device mounts to a golf club and signals to the golfer when the club head begins decelerating in the direction of the forward motion of a golf swing. Additional energy is available for transfer from the club head to the ball as the club head is transitioning from acceleration to deceleration. This additional energy comes from the change in the direction of the flexing of the club. By using the training device, a golfer may practice timing his swing to contact the ball with the club head just prior to the beginning of deceleration of the club head during the course of a typical swing. Utilization of the additional available energy may result in increased ball-driving distance. Additionally, contacting the ball while the club is in a straight position, during the transition of the direction of flex, promotes a more accurate drive.

8 Claims, 6 Drawing Sheets

SYSTEM AND METHOD FOR GOLF-SWING TRAINING

CROSS-REFERENCE TO RELATED APPLICATION

This application claims the benefit of provisional patent application No. 60/526,200, filed Dec. 3, 2003.

TECHNICAL FIELD

The present invention relates to the field of golf and, more particularly, to a system and method for golf-swing training.

BACKGROUND OF THE INVENTION

An improved golf swing is a common goal of many golfers of all skill levels. Golf enthusiasts have discovered that small golf-swing adjustments can make noticeable differences in the accuracy and distance of ball placement. In a round of golf, continual use of proper techniques of body-stance, club-grip, and swing-timing may improve performance by multiple strokes. Accordingly, some golfers practice various techniques for improving their swing. For improved ball-driving distance and accuracy, appropriate swing timing may be a key factor. Thus, golf enthusiasts have recognized a need for a club-mounted training device for improving golf-swing timing to promote increased ball-driving distance and accuracy.

SUMMARY OF THE INVENTION

The present invention is a golf-club-mounted training device for increasing golf-ball-driving distance and accuracy. A golfer is cued when, during the course of the forward motion of a typical golf swing, the club head begins to decelerate. Using the training device, the golfer is able to practice timing his swing to contact the ball at a point just before the club head is beginning to decelerate. Timing a golf swing to coincide ball-contact just prior to the beginning of deceleration may result in an increase in available energy in the head of the golf club for transfer to the golf ball. Increased energy transfer may result in increased ball-driving distance. Additionally, just prior to deceleration, the club is in a straight position. Contacting the ball while the club is in a straight position may result in a more accurate drive.

In one embodiment of the invention, a removably-attachable training device is mounted to a golf club above the club head. A unidirectional switch, containing a pendulum, completes a circuit when the training device is decelerating in the direction specified by the switch. The switch is oriented to make the forward motion of a swing the direction of motion. Completion of the circuit illuminates an array of light-emitting diodes directed toward the eyes of the golfer. By using the training device, the golfer is able to see where deceleration begins to occur in his swing. The golfer may then attempt to make adjustments in the timing of his swing to make the light-emitting diodes illuminate immediately after to making contact with the ball, without sacrificing accuracy and velocity of his swing. Utilizing such a technique helps to maximize the energy available for transfer from the golf club to the golf ball, consequently promoting an increase in ball-driving distance and accuracy.

DETAILED DESCRIPTION OF THE INVENTION

The present invention is a golf-swing training device for use with a golf club. The training device promotes increased ball-driving distance by signaling to the golfer when the club-mounted training device begins to decelerate during the forward motion of a golf-swing and also signals to the golfer when the club has returned to a straight position from a flexed position.

The distance that a golf ball travels is related to how much energy the club head transfers to the ball during contact. Thus, one technique for increasing driving distance is to put more energy into the club head. Typically, much of the energy in the club during an average swing is in the form of kinetic energy. However, energy also exists in the form of potential energy due to flexing of the shaft of the average golf club as the club is accelerating during a swing.

Figure 1:
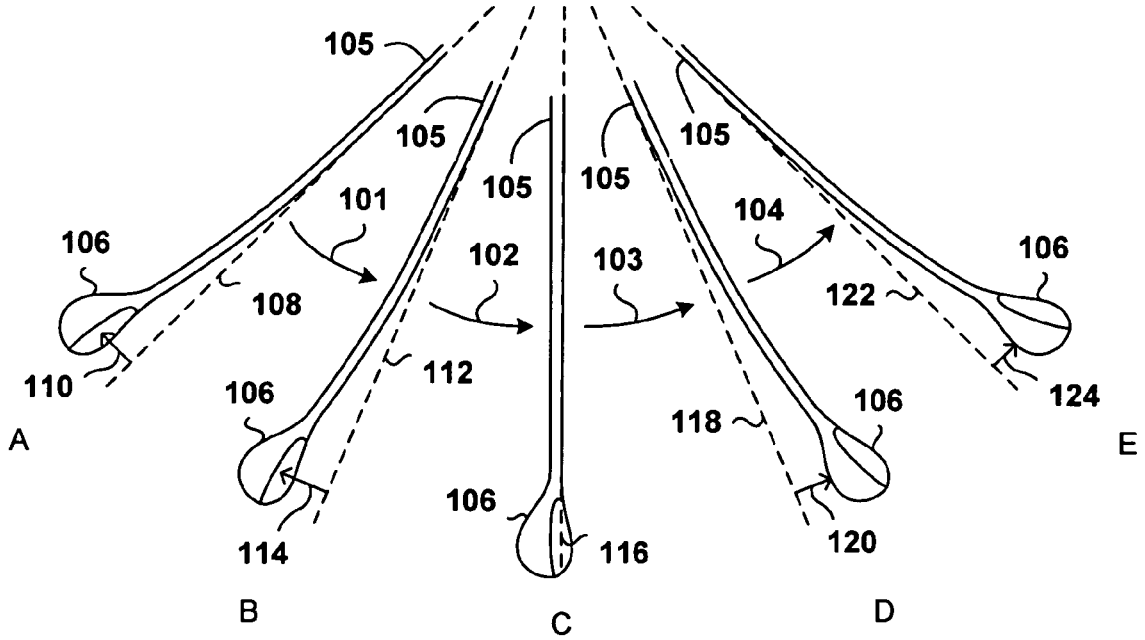
FIG. 1 illustrates the flexing of a golf club at several positions during the forward motion of a typical swing.

FIG. 1 illustrates the flexing of a golf club at several positions during the forward motion of a typical swing. Curved arrows 101-104 show the direction of travel of the golf club 105. At position A, near the beginning of a typical swing, the angular velocity of the golf head 106 is increasing from rest, so the initial angular acceleration is positive. The club head 106 is flexed backward, lagging behind the direction of the swing. At position A, the dashed line 108 represents a virtual image of the golf club 105 with no flex, and the arrow 110 represents the shortest distance from the virtual, rigid club 108 to the real club head 106. Position B illustrates a second point in the swing where the acceleration is still positive. The club head 106 is still flexed backward, lagging the virtual image of the rigid club 112 by a distance 114.

At some point during the average forward motion of the swing, the acceleration in the angular velocity of the club begins to decrease, after which point the club head also begins to decelerate. Once the golf club 105 begins to decelerate, the golf club 105 begins to straighten out and eventually flex in the opposite direction. Position C illustrates a point where the golf club 105 has just recently begun to decelerate. The club 105 is rigid and the club head 106 overlaps the virtual, rigid club 116. At position D, the golf club 105 continues to decelerate. As a result, the golf club 105 begins to flex in the opposite direction, causing the club head 106 to lead the virtual, rigid club 118 by a distance 120. In position E, the angular velocity is still decreasing and the club head 106 is still leading the virtual, rigid club 122 by a distance 124.

Timing a golf swing to take advantage of the extra energy available when the flex of the club head is transitioning from a lagging position to a leading position would result in greater available energy to transfer from the club head to the ball. Greater available energy may improve ball-driving distance. Additionally, contacting the ball while the club is straight may improve accuracy of ball-driving.

FIGS. 2 A-D illustrate one embodiment of the invention. FIG. 2A is a top view of the training device. The training device 202 includes a top surface 204 with a hooked portion 206 for attachment to the shaft of a golf club. The top surface 204 further contains an aperture through which an array of light-emitting diodes ("LEDs") 208 projects. Suitable materials for fabricating the training device would include such materials as plastic, wood, or other lightweight sturdy material. Directional arrow 209 illustrates the direction of the forward motion of a typical golf swing. Note that, when the training device 202 is properly mounted to a club, arrow 209 points away from the front face of the club, the ball-contact surface.

The top surface 204 and LED array 208 are removable for replacement of the LED array 208 and/or adapting the training device 202 for use with left-handed golf clubs. For example, the LED array 208 and top surface 204 may be disconnected and removed. The top surface 204 may then be flipped over upside down and/or the LED array 208 replaced. The top surface 204 and the LED array may then be reattached to the training device 202.

Figure 2A:
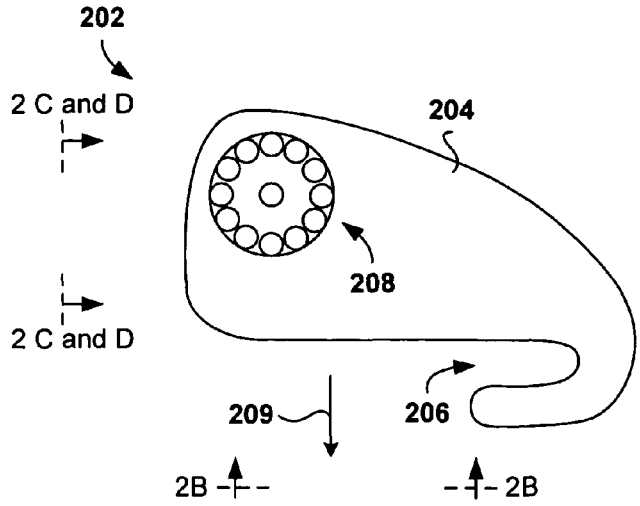
FIGS. 2 A-D illustrate alternate views of one embodiment of the training device.
Figure 2C:
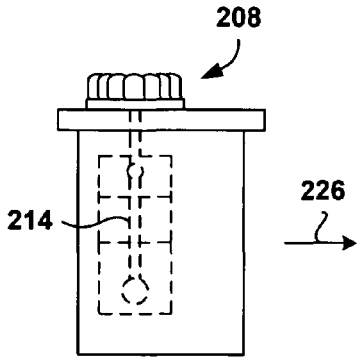
Figure 2B:
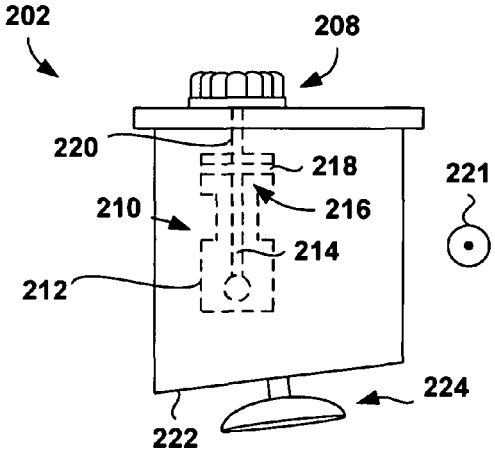

FIG. 2B is a side view of one embodiment of the training device. The array of LEDs 208 is connected to a motion switch 210 within a motion-switch housing 212. The motion switch 210 contains an electro-conductive pendulum 214. The pendulum 214 swings from a pivot 216. The pivot 216 is a pin 218 attached at both ends to opposite edges of the motion-switch housing 212. The pin 218 is oriented parallel with the front face of the club head so that the pendulum 214 is capable of swinging either with the direction of the forward motion of the golf swing, or against the direction of the forward motion of the golf swing. Dotted line 220 is an electro-conducting wire connecting the pendulum 214 to the LEDs 208, forming part of an electric circuit. Directional arrow 221 illustrates the direction of the forward motion of a typical golf swing. The arrow 221 is pointing out of the plane of the page.

The training device 202 includes a tapered bottom surface 222 angled obliquely to the top surface 204. The tapered bottom surface 222 orients the training device 202 so the top surface 204 faces the direction of the eyes of an average golfer while swinging a golf club, thus promoting visibility of the LEDs 208 to the golfer. The bottom surface 222 includes a suction cup 224. The suction cup 224 removably attaches to the top surface of a club head. In an alternate embodiment, the suction cup is replaced with a hook and loop fastener. The first strip of the hook and loop fastener is affixed to the bottom surface of the training device, while the second strip of the hook and loop fastener is affixed to the top of the club head. In various alternate embodiments, the training device is attached to the club head by other types of fasteners such as rope, brackets, rubber bands, snaps, socks, sewn sleeves, or tape. One or more layers of padding, such as rubber or foam, may also be used in conjunction with the various fasteners to promote a secure fit without damaging the training device and/or the club head. Additionally, in other alternate embodiments, the training device is permanently mounted to a club by various methods, such as by glue, nails or bolts.

Figure 2D:
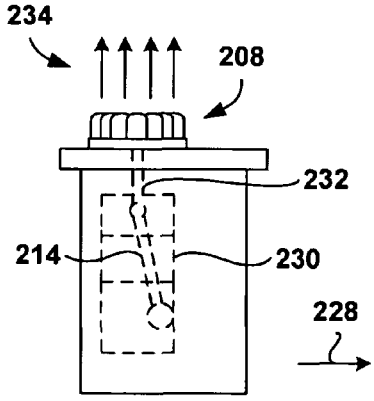

FIGS. 2C and D are end views of one embodiment of the training device. FIG. 2C shows the training device 202 with no acceleration. The pendulum 214 hangs down and the LEDs 208 are not illuminated. Directional arrow 226 illustrates the direction of the forward motion of a typical golf swing. FIG. 2D shows the training device accelerating to the left. Directional arrow 228 illustrates the direction of the forward motion of a typical golf swing. Since the two motions are in opposite directions, the training device 202 is decelerating. The deceleration causes the pendulum 214 is swung to the right, contacting an electro-conductive plate 230. Dotted line 232 is an electro-conductive wire connecting the electro-conductive plate 230 to the LEDs 208. A circuit is completed when the pendulum 214 contacts the electro-conductive plate 230. The completed circuit causes the LEDs 208 to illuminate, as shown by illumination arrows 234. Note that a power source must exist somewhere within the circuit, as discussed with regards to FIGS. 4 A and B. Also note that the power supply may be external to the training device. Thus, external wires, passing through an outer surface of the training device, may be necessary for connecting the power supply to the training device.

Figure 3:
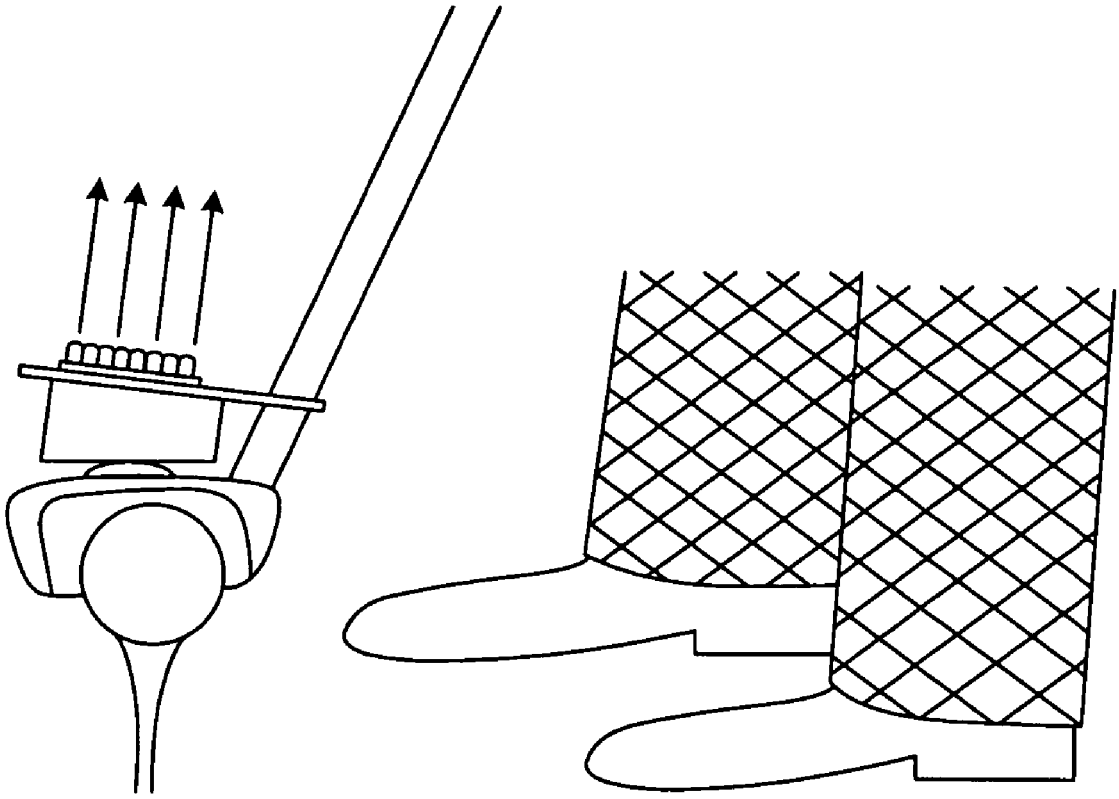
FIG. 3 illustrates one embodiment of the training device mounted to a golf club.

FIG. 3 illustrates the training device mounted to a golf club. The training device is decelerating in the direction of the forward motion of the swing. Accordingly, the LEDs are illuminated. In an alternate embodiment, the training device is attached to the club at a greater distance from the club head. The LEDs project from the bottom surface of the training device and illuminate downward. The light reflects upward, toward the eyes of the golfer, from a reflective coating applied to the top surface of the club head. In yet another embodiment of the training device, one or more lenses are used to focus the light in the eyes of the golfer.

Figure 4A:
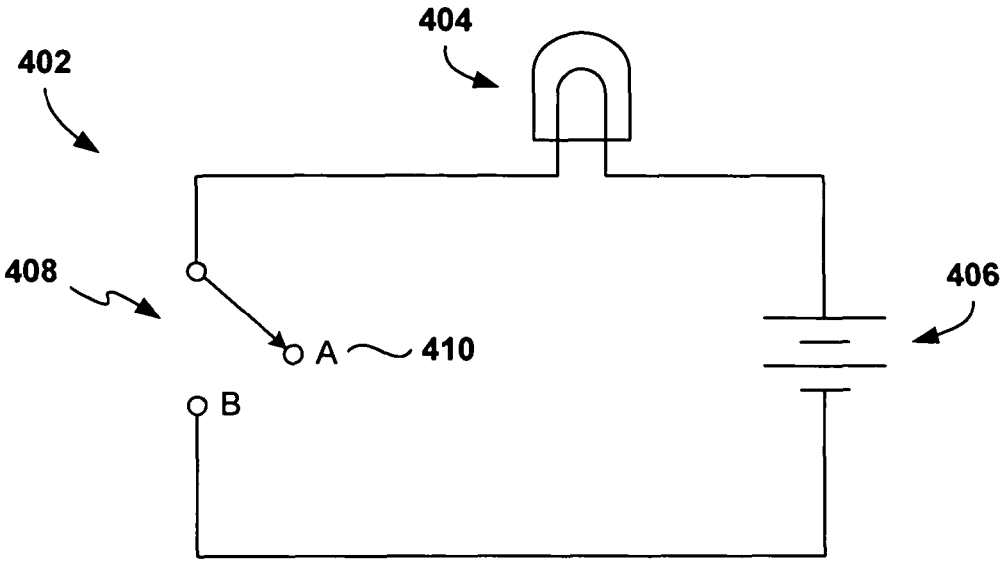
FIGS. 4A and B illustrate a circuit diagram for one embodiment of the training device.
Figure 4B:
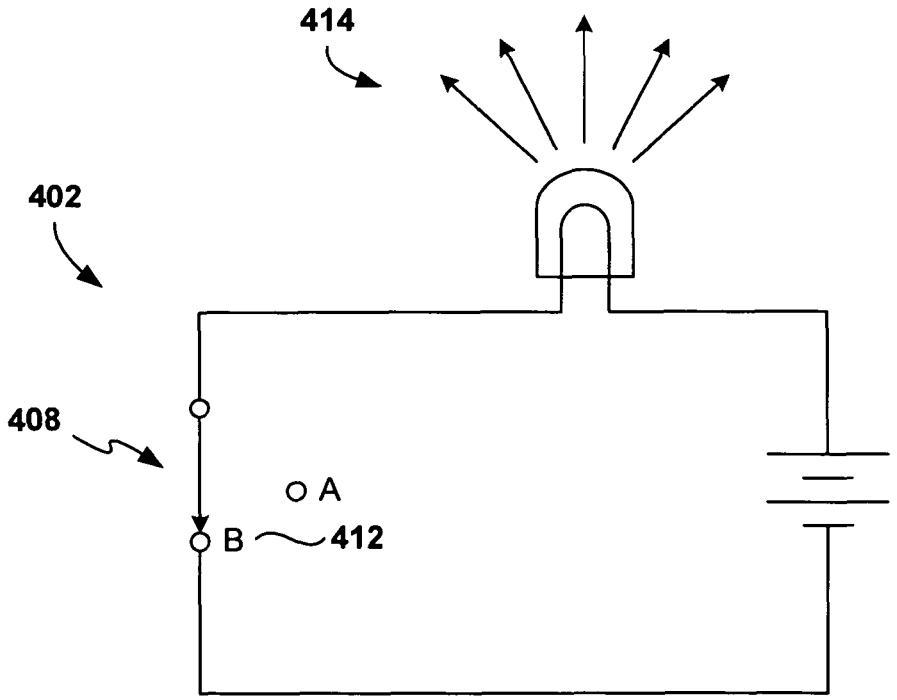

FIGS. 4A and B illustrate one embodiment of a circuit diagram for the training device. FIG. 4A shows a circuit 402. The circuit 402 includes a lamp 404, a power source 406, and a switch 408 in open position A 410. The circuit 402 is open and the lamp 404 is off. FIG. 4B shows circuit 402 with the switch 408 in a closed position B 412. The closed switch 408 completes the circuit and the lamp 404 illuminates, as shown by illumination arrows 414.

In alternate embodiments, the lamp 404 may be an LED, or an array of more than one LED, or may be another source of illumination such as one or more strobe lights, xenon lights, incandescent lights, or laser lights. The power source may be either alternating current or direct current and may be of any voltage appropriate for illuminating the light source. When batteries are employed as a power source, the batteries may be either contained within the training device, or external to the training device as a battery pack or compartment. For instance, in one embodiment one or more batteries may be inserted into a battery compartment built into the shaft of a golf club in proximity to the grip. The batteries may then be connected to the training device within the club, thus eliminating external wires. Additionally, in alternate embodiments the circuit 402 may include a capacitor as a source of electrical power for the light, rather than a battery. The capacitor may be recharged by capturing kinetic energy from the movement of the club through an electromechanical system. Thus, illumination occurs as a pulse of light at the beginning of deceleration. Note that there is a time interval between light pulses when the capacitor is charging.

Figure 5A:
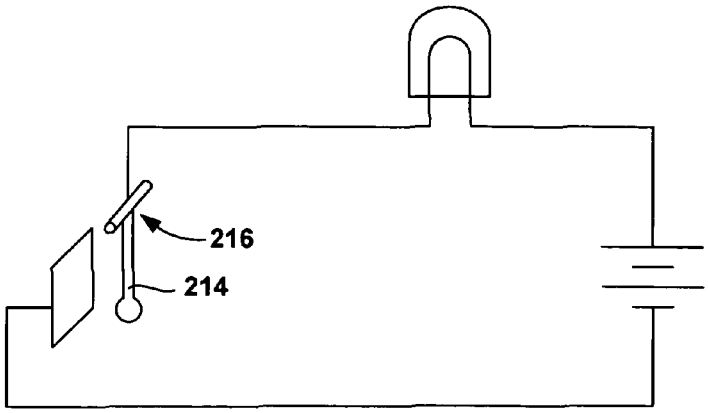
FIGS. 5 A-C illustrate the circuit of the embodiment of the training device shown in FIGS. 4 A and B, employing the embodiment of the motion switch shown in FIGS. 2 B-D.
Figure 5B:
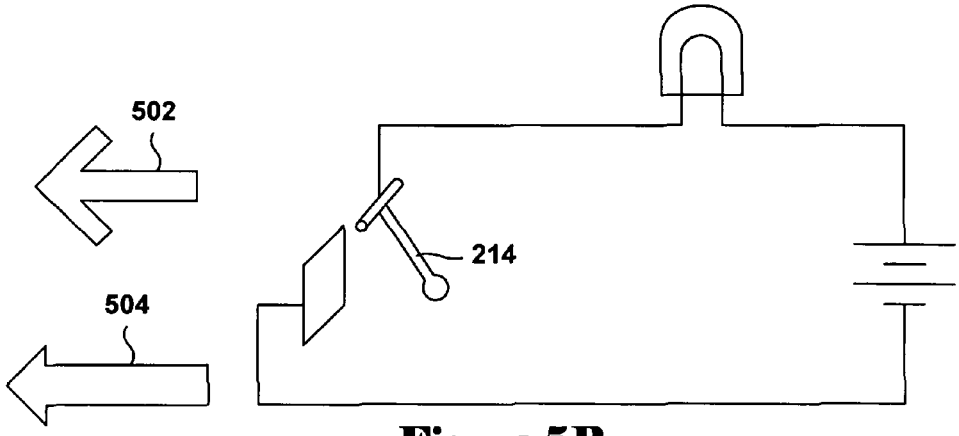
Figure 5C:
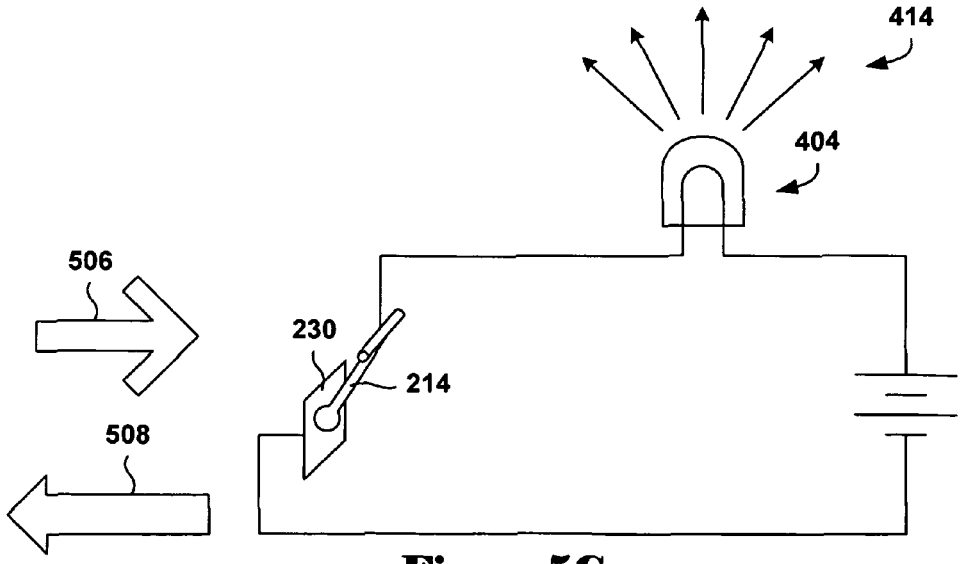

FIGS. 5 A-C illustrate the circuit of the embodiment of the training device shown in FIGS. 4 A and B, employing the embodiment of the unidirectional motion switch shown in FIGS. 2 B-D. FIG. 5A shows the pendulum 214 hanging straight down from the pivot 216. FIG. 5B shows the pendulum swung to the right. The pendulum 214 swings to the right when the training device, 202 in FIGS. 2 A-D, is accelerating to the left, as indicated by acceleration arrow 502. Directional arrow 504 illustrates the direction of the forward motion the golf swing. Both arrows 502 and 504 are in the same direction; hence the acceleration is increasing. Conversely, FIG. 5C shows the pendulum swung to the left. The pendulum 214 swings to the left when the training device, 202 in FIGS. 2 A-D, is accelerating to the right, as indicated by acceleration arrow 506. Directional arrow 508 illustrates the direction of the forward motion the swing. Arrows 506 and 508 are in opposite directions; hence the device is decelerating. When the pendulum 214 is swung to the left, contact is made with the electro-conductive plate 230. The circuit is completed and the lamp 404 illuminates, as shown by illumination arrows 414.

Figure 6A:
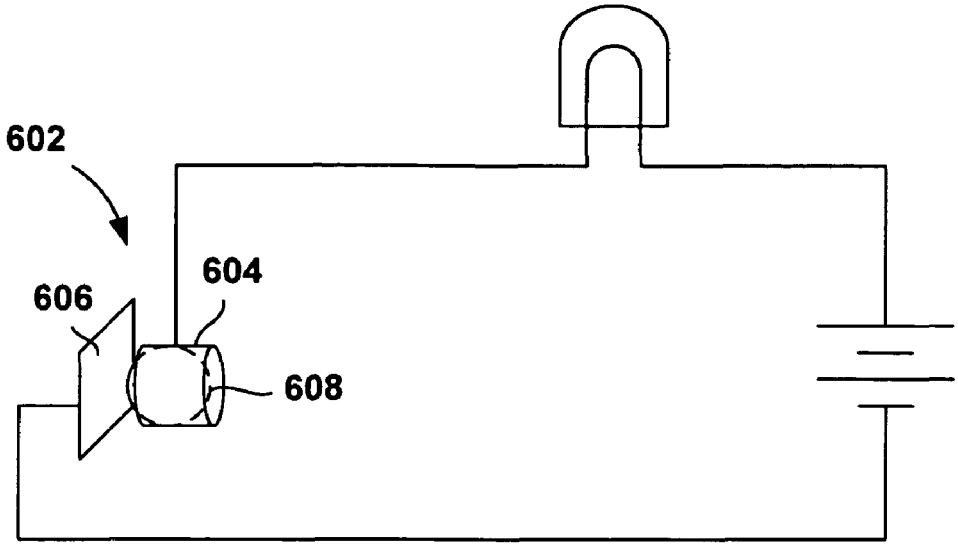
FIGS. 6A and B illustrate the circuit of the embodiment of the training device shown in FIGS. 4 A and B, employing an alternate embodiment of the motion switch.
Figure 6B:
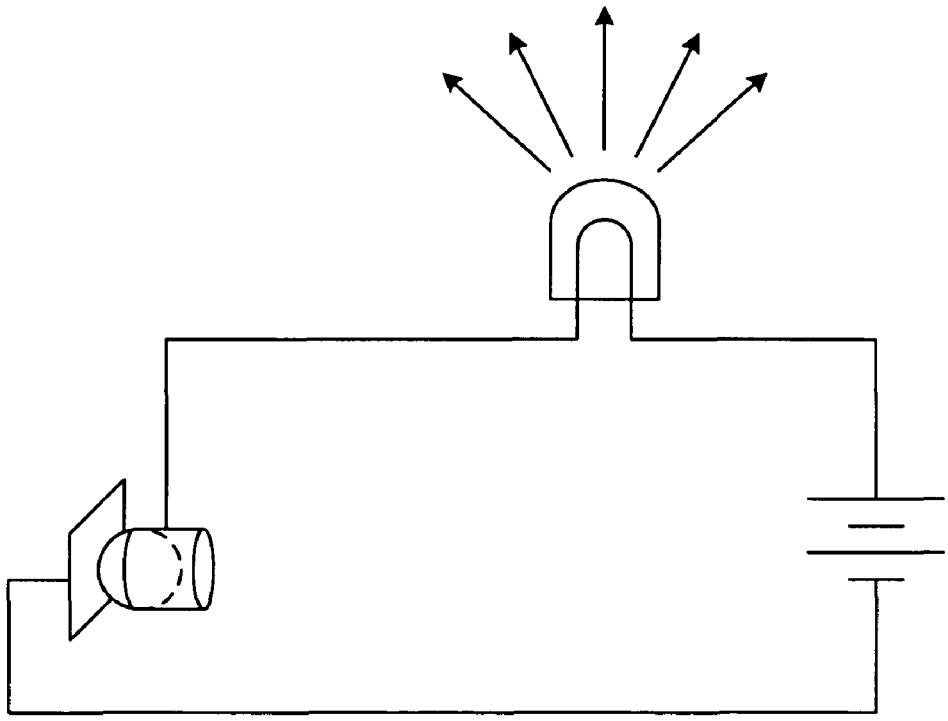

FIGS. 6A and B illustrate the circuit of the embodiment of the training device shown in FIGS. 4 A and B, employing an alternate embodiment of the motion switch. FIG. 6A shows the switch in an open position. One side of the switch 602 is connected to an electro-conductive tube 604 positioned orthogonally to the face of the club head. The tube 604 is open on the end closest to the club face and closed on the opposite end. The opposite side of the switch 602 is connected to an electro-conductive plate 606 extending roughly parallel to the club face and positioned a distance from the open end of the tube 604 of less than the diameter of the tube 604. Contained within the tube 604 is an electro-conductive sphere 608 with a diameter slightly less than the tube 602. Deceleration of the switch 602 in the direction of the forward motion of a golf swing causes the sphere 608 within the tube 604 to roll towards the plate 606. FIG. 6B shows the switch in a closed position. The sphere 608 is contacting both the tube 604 and the plate 606, thus completing the circuit and illuminating the lamp. Note that the sphere is unable to roll completely out of the tube due to the proximity of the tube and the plate.

Although the present invention has been described in terms of a particular embodiment, it is not intended that the invention be limited to this embodiment. Modifications within the spirit of the invention will be apparent to those skilled in the art. For example, many types of component configurations and methods of attaching and mounting components within the training device, and attaching and mounting the training device to various golf clubs different from those shown in the figures and described in the above text may be employed. Moreover, the training device may employ alternate methods of signaling to the use of light. For instance, the training device may signal deceleration by sounding an audio alarm or vibrating the golf club.

The foregoing detailed description, for purposes of illustration, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description; they are not intended to be exhaustive or to limit the invention to the precise forms disclosed. Obviously many modifications and variation are possible in view of the above teachings. The embodiments were chosen and described in order to best explain the principles of the invention and its practical applications and to thereby enable others skilled in the art to best utilize the invention and various embodiments with various modifications as are suited to the particular use contemplated.

The invention claimed is:

1. A golf-swing training device, for use by a golfer with a golf club, the golf club including a shaft and a club head, the golf-swing training device comprising:

an attachment mechanism for attaching the training device to the golf club;

a power source electrically connected to the training device;

a unidirectional motion switch; and a signaling source, connected by the unidirectional motion switch, for signaling to the golfer the beginning of deceleration of the club head following acceleration during the forward motion of a golf swing.

2. The training device of claim 1 wherein the attachment mechanism is one or more of:

one or more hooks;
one or more suction cups;
a hook and loop fastener;
rope;
one or more brackets;
one or more rubber bands;
one or more snaps;
a sewn sleeve;
tape;
glue;
one or more nails; and
one or more bolts.

3. The training device of claim 1 wherein the power source utilizes one of:

a battery;
a capacitor; and
an external power supply.

4. The training device of claim 1 wherein the motion switch comprises:

an electro-conductive plate; and a free-swinging electro-conductive pendulum that completes a circuit when contacting the electro-conductive plate, the pendulum contacting the plate when the training device begins decelerating in the direction of motion of the unidirectional motion switch.

5. The training device of claim 1 wherein the signaling source emits a light signal to the golfer.

6. The training device of claim 5 wherein the light signal is one of:

one or more light-emitting diodes;
one or more strobe lights;
one or more incandescent lights;
one or more laser lights; and
one or more xenon lights.

7. The training device of claim 1 wherein the signaling source emits an auditory signal to the golfer.

8. The training device of claim 1 wherein the signaling source emits a vibrational signal to the golfer.

* * * * *